US010502516B2

(12) United States Patent
Bednar et al.

(10) Patent No.: US 10,502,516 B2
(45) Date of Patent: Dec. 10, 2019

(54) CROSSBOW CAM

(71) Applicant: Hunter's Manufacturing Company, Inc., Suffield, OH (US)

(72) Inventors: Richard Bednar, Munroe Falls, OH (US); Phil Bednar, Copley, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

(21) Appl. No.: 16/203,961

(22) Filed: Nov. 29, 2018

(65) Prior Publication Data

US 2019/0162500 A1 May 30, 2019

Related U.S. Application Data

(60) Provisional application No. 62/591,836, filed on Nov. 29, 2017.

(51) Int. Cl.
*F41B 5/12* (2006.01)
*F41B 5/10* (2006.01)

(52) U.S. Cl.
CPC ..... *F41B 5/105* (2013.01); *F41B 5/123* (2013.01)

(58) Field of Classification Search
CPC ..... F41B 5/105; F41B 5/12; F41B 5/123
See application file for complete search history.

(56) References Cited

U.S. PATENT DOCUMENTS 2,092,361 A 9/1937 Shim
3,043,287 A 7/1962 Nelson
3,561,419 A 2/1971 Cucuzza, Sr.
3,670,711 A 6/1972 Firestone
3,739,765 A 6/1973 Moore
4,192,281 A 3/1980 King
4,246,883 A 1/1981 Ash
4,593,675 A 6/1986 Waiser
4,603,676 A 8/1986 Luoma
4,649,892 A 3/1987 Bozek
4,662,345 A 5/1987 Stephens
4,665,885 A 5/1987 Glomski et al.
4,719,897 A 1/1988 Gaudreau
4,721,092 A 1/1988 Waiser
4,942,861 A 7/1990 Bozek
(Continued)

OTHER PUBLICATIONS

A Guide to the Crossbow, by W.F. Paterson, published by the Society of Archer-Antiquaries, 1990.
(Continued)

*Primary Examiner* — John A Ricci
(74) *Attorney, Agent, or Firm* — Emerson Thomson Bennett, LLC

(57) ABSTRACT

Provided is a crossbow comprising a bow having: a riser having a first riser side and a second riser side; a first cam set having a first shaft, a first power cord cam of the first cam set, a bowstring cam, and a second power cord cam of the first cam set; a second cam set having a second shaft, a first power cord cam of the second cam set, a bowstring cam, and a second power cord cam of the second cam set; a first power cord engaged with the first power cord cam of the first cam set and the first riser side; a second power cord engaged with the first power cord cam of the second cam set and the second riser side; and a third power cord engaged between the second power cord cams.

19 Claims, 4 Drawing Sheets

(56) References Cited

U.S. PATENT DOCUMENTS

| | | | | |
|---|---|---|---|---|
| 5,115,795 | A | 5/1992 | Farris | |
| 5,205,267 | A | 4/1993 | Burdick | |
| 5,215,069 | A | 6/1993 | Liu | |
| 5,220,906 | A | 6/1993 | Choma | |
| 5,243,956 | A | 9/1993 | Luehring | |
| 5,433,186 | A | 7/1995 | Corwin | |
| 5,437,260 | A | 8/1995 | King | |
| 5,445,139 | A | 8/1995 | Bybee | |
| 5,553,596 | A | 9/1996 | Bednar | |
| 5,598,829 | A | 2/1997 | Bednar | |
| 5,649,520 | A | 7/1997 | Bednar | |
| 5,678,528 | A | 10/1997 | Hadley | |
| 5,987,724 | A | 11/1999 | Kleman | |
| 6,095,128 | A | 8/2000 | Bednar | |
| 6,286,496 | B1 | 9/2001 | Bednar | |
| 6,874,491 | B2 | 4/2005 | Bednar | |
| 6,913,007 | B2 | 7/2005 | Bednar | |
| 7,100,590 | B2 | 9/2006 | Chang | |
| 7,624,725 | B1 | 12/2009 | Choma | |
| 7,784,453 | B1 | 8/2010 | Yehle | |
| 8,443,790 | B2 | 5/2013 | Pestrue | |
| 8,499,753 | B2 | 8/2013 | Bednar | |
| 9,243,861 | B1 * | 1/2016 | Kempf | F41B 5/12 |
| 9,879,938 | B1 * | 1/2018 | Isenhower | F41B 5/123 |
| 10,018,442 | B1 * | 7/2018 | Kempf | F41B 5/123 |
| 10,048,036 | B1 * | 8/2018 | Kempf | F41B 5/105 |
| 10,139,191 | B1 * | 11/2018 | Kempf | F41B 5/123 |
| 2006/0086346 | A1 | 4/2006 | Middleton | |
| 2010/0170488 | A1 | 1/2010 | Rasor et al. | |
| 2015/0285581 | A1 * | 10/2015 | Chang | F41B 5/123 124/25 |
| 2018/0094895 | A1 * | 4/2018 | Yehle | F41B 5/066 |

OTHER PUBLICATIONS

European Crossbows, A Survey by Josef Alm, copyrighted by the Trustees of the Royal Armouries and the Arms and Armour Society, 1994.

The Book of the Crossbow, by Ralph Payne-Gallwey, published by Dover Publications, Inc. of New York, 1995.

* cited by examiner

CROSSBOW CAM

CROSS-REFERENCE TO RELATED APPLICATIONS

This application claims the benefit of U.S. Provisional Application No. 62/591,836, filed Nov. 29, 2017, the entirety of which is fully incorporated by reference herein.

BACKGROUND

The present subject matter is directed to apparatuses and methods regarding crossbows. More specifically the present subject matter is directed to apparatuses and methods for cams for a crossbow.

Crossbows have been used for many years as a weapon for hunting and fishing, and for target shooting. Crossbows typically comprise a bowstring engaged through a set of pulleys or cams to a set of limbs and to a set of power cords. Engagement of the set of power cords is of interest. It is of interest to make the engagement of the set of power cords reliable, light, inexpensive, low maintenance, efficient, safe, and adjustable.

One known issue affecting or relevant to reliability, weight, cost, maintenance, efficiency, and safety is "cam lean". Cam lean is the operation of one or more cams out of alignment with a design operational plane due to force imbalances or other factors.

It remains desirable to improve engagement of the set of power cords to reduce, minimize, or eliminate cam lean.

SUMMARY

Provided is a crossbow comprising a bow having: a riser having a first riser side and a second riser side; a first cam set having a first shaft, a first power cord cam of the first cam set, a bowstring cam, and a second power cord cam of the first cam set; a second cam set having a second shaft, a first power cord cam of the second cam set, a bowstring cam, and a second power cord cam of the second cam set; a first power cord engaged with the first power cord cam of the first cam set and the first riser side; a second power cord engaged with the first power cord cam of the second cam set and the second riser side; and a third power cord engaged between the second power cord cams

BRIEF DESCRIPTION OF THE DRAWINGS

The present subject matter may take physical form in certain parts and arrangement of parts, embodiments of which will be described in detail in this specification and illustrated in the accompanying drawings which form a part hereof and wherein.

DEFINITIONS

Figure 1:
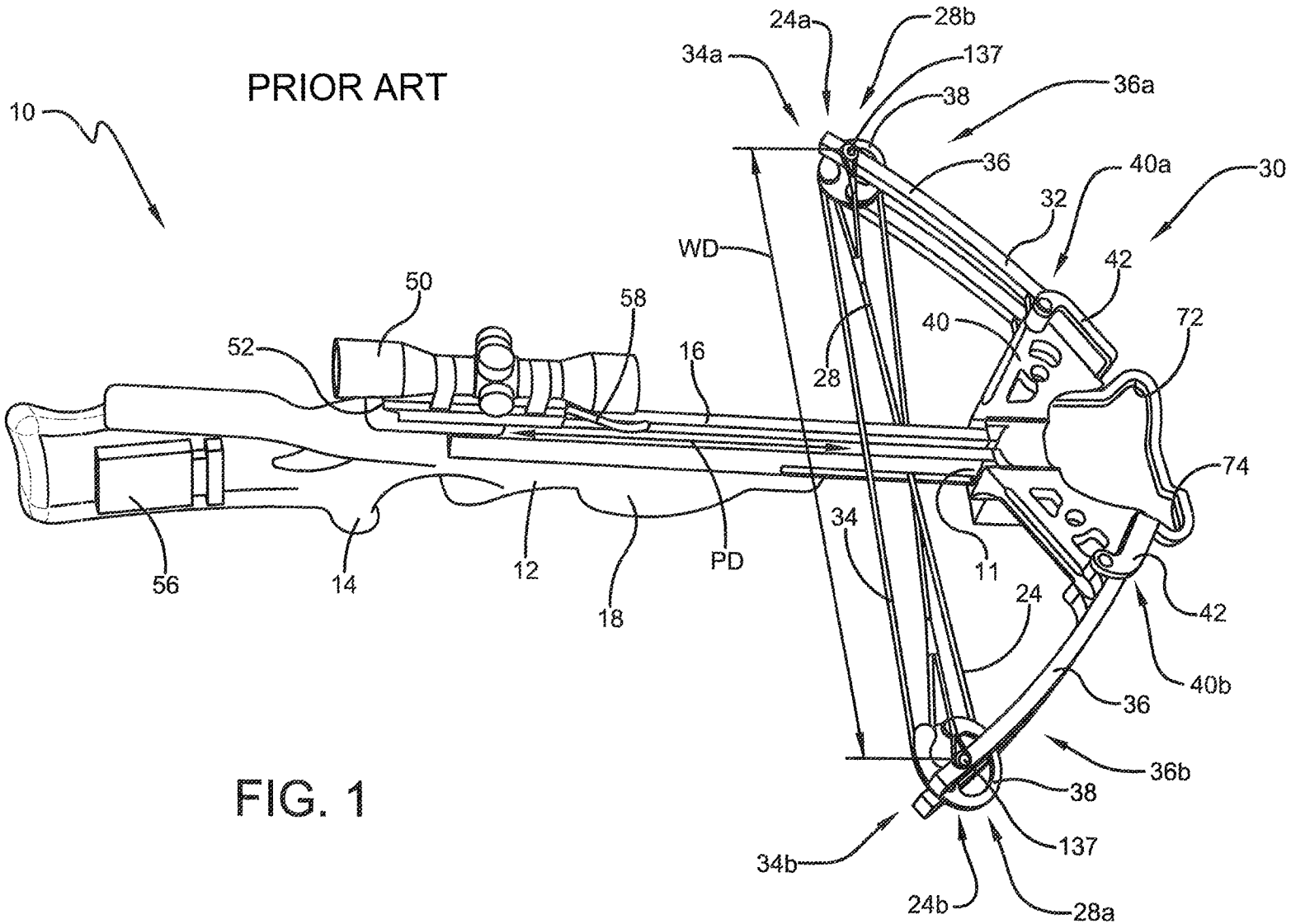
PRIOR ART FIG. 1
FIG. 1 is a view of one non-limiting embodiment of a conventional crossbow.

The following definitions are controlling for the disclosed subject matter:

"Arrow" means a projectile that is shot with (or launched by) a bow assembly.

"Bow" means a bent, curved, or arched object.

"Bow Assembly" means a weapon comprising a bow and a bowstring that shoots or propels arrows powered by the elasticity of the bow and the drawn bowstring.

"Bowstring" means a string or cable attached to a bow.

"Compound Bow" means a crossbow that has wheels, pulleys or cams at each end of the bow through which the bowstring passes.

"Crossbow" means a weapon comprising a bow assembly and a trigger mechanism both mounted to a main beam.

"Draw Weight" means the amount of force required to draw or pull the bowstring on a crossbow into a cocked condition.

"Main Beam" means the longitudinal structural member of a weapon used to support the trigger mechanism and often other components as well. For crossbows, the main beam also supports the bow assembly. The main beam often comprises a stock member, held by the person using the weapon, and a barrel, used to guide the projectile being shot or fired by the weapon.

"Power Stroke" means the linear distance that the bowstring is moved between the uncocked condition and the cocked condition.

"Trigger Mechanism" means the portion of a weapon that shoots, fires or releases the projectile of a weapon. As applied to crossbows, trigger mechanism means any device that holds the bowstring of a crossbow in the drawn or cocked condition and which can thereafter be operated to release the bowstring out of the drawn condition to shoot an arrow.

"Weapon" means any device that can be used in fighting or hunting that shoots or fires a projectile including bow assemblies and crossbows.

DETAILED DESCRIPTION

Referring now to the drawings wherein the showings are for purposes of illustrating embodiments of the present subject matter only and not for purposes of limiting the same, and wherein like reference numerals are understood to refer to like components, provided are a crossbow cam and a method of using a crossbow cam.

FIG. 1 shows a crossbow 10. While the crossbow 10 shown uses a compound bow, it should be understood that this invention will work well with any type of crossbow chosen with sound judgment by a person of ordinary skill in the art.

The crossbow 10 has a main beam 12 which may include a stock member 14, and a barrel 16. The main beam 12 may be made by assembling the stock member 14 and the barrel 16 together as separate components or, in another embodiment, the main beam 12 may be made as one piece. A handgrip 18 may be mounted to the main beam 12 in any conventional manner chosen with sound judgment by a person of ordinary skill in the art. A trigger mechanism suitable for shooting an arrow is mounted to the main beam 12 in any suitable manner. It should be noted that the crossbow 10 may comprise any trigger mechanism chosen with sound judgment by a person of ordinary skill in the art. The crossbow 10 also includes a bow assembly 30 adapted to propel an associated arrow and having a bow 32 and a bowstring 34. The bow 32 may include a set of limbs 36, 36 that receive the bowstring 34 in any conventional manner chosen with sound judgment by a person of ordinary skill in the art. For the embodiment shown, a pair of wheels, pulleys, or cams 38, 38 mounted to the limbs 36, 36 receive the bowstring 34 in an operational manner. In each of the non-limiting embodiments, the set of limbs has a first limb set 36*a* and a second limb set 36*b* opposite the first limb set 36*a* with first limb set 36*a* being operationally engaged with a first cam 38 and second limb set 36*b* being operationally engaged with a second cam 38. The bow may also include a riser 40. The riser 40 may comprise a set of limb pockets 42, 42 adapted to receive the limbs 36, 36, as shown in FIG. 1 with the first limb set 36*a* engaged to a first riser side 40*a* and the second limb set 36*b* engaged to a second riser side 40*b*. The first limb set 36*a* may define a first limb axis 492 about which a cam 38 or cam set 240 may be rotatably engaged. The second limb set 36*b* may define a second limb axis 494 about which a cam 38 or cam set 240 may be rotatably engaged. In the non limiting embodiments shown in FIG. 4 the second limb axis 494 is parallel to the first limb axis 492.

Without limitations, other crossbow components may be optionally used with a crossbow as provided herein. Without limitation, in some non-limiting embodiments, a crossbow 10 shown may include a scope 50 attached to a scope mount 52 that is supported on the main beam 12. Other optional components shown include a cocking unit 56, and arrow holder 58. In certain non-limiting embodiments, the riser 40 may have an opening 72 formed therein defining a foot stirrup 74 adapted for holding and balancing the crossbow by foot.

A crossbow 10 may have a power stroke distance PD. The distance between the pivot axes of the wheels, pulleys, or cams 38, 38 may be some distance WD.

Figure 3:
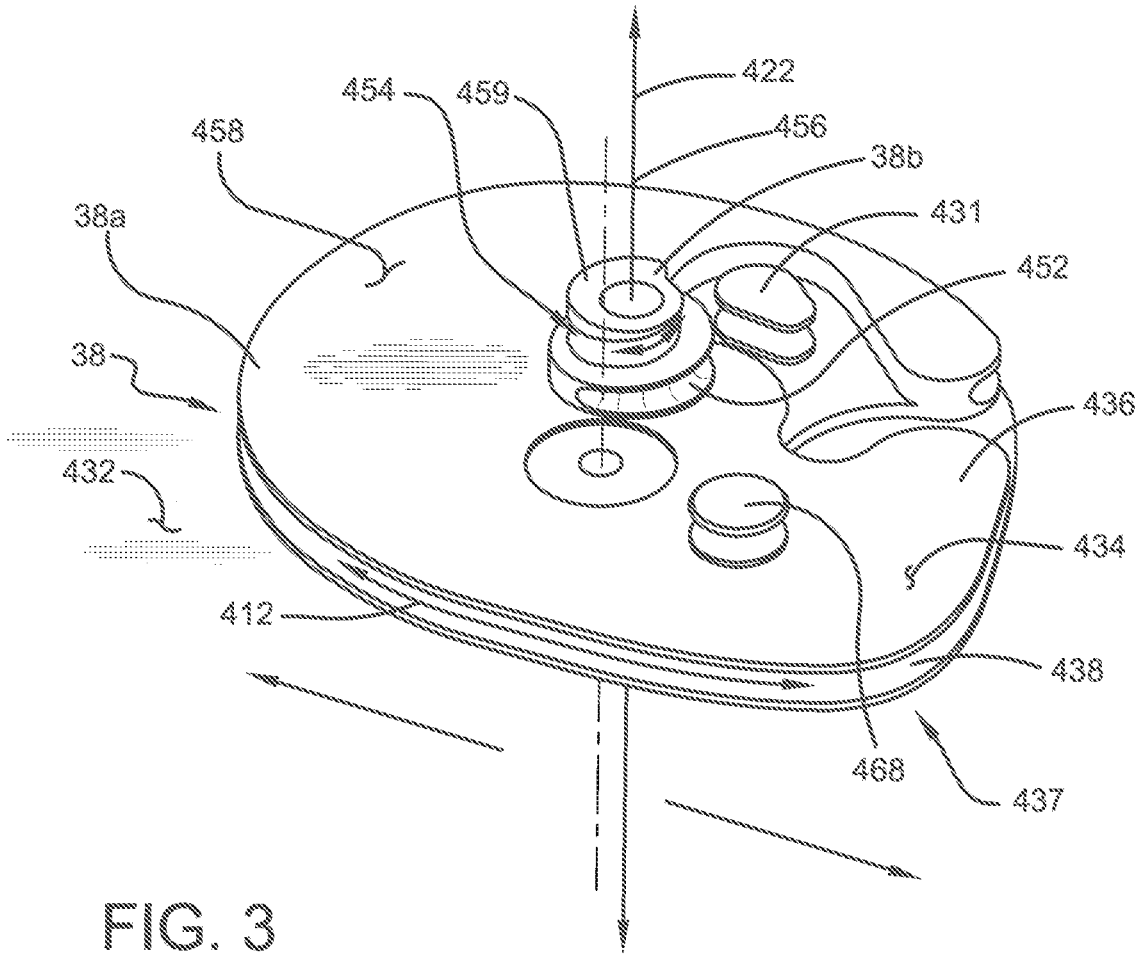
FIG. 3 is view of one non-limiting embodiment of crossbow cams.

With reference to the non-limiting configurations of cams 38 shown in FIG. 3, a cam 38 may be a planar cam 38*a* comprising a first cam axis 422, a first cam plane 432 normal to the first cam axis 422, a first cam plate 434. The first cam plate 434 may have a first top surface 436, a first bottom surface 437 opposite the first top surface 436, and a first perimeter surface 438. A first perimeter surface 438 may extend between the first top surface 436 and the first bottom surface 437, the first perimeter surface 438 may define a first concave channel 439 extending around the first cam axis 422 along a first plane curve 412 within the first cam plane 432. The concave channel 439 may be a bowstring channel or a power cord channel. The first plane curve 412 may vary in distance from the first cam axis 422 or may be a constant radial distance from the first cam axis 422. In those embodiments in which the first plane curve is a constant radius distance from the first cam axis 422, the planar cam 38*a* is round wheel, or section of a round wheel, with the first cam axis 422 coincident with the wheel center. In those embodiments in which the first plane curve 412 varies in distance from the first cam axis 422, the planar cam 38*a* is a variable radius planar cam 38*a*. In some non-limiting embodiments, a cam 38 may optionally have an internal securement feature 431 adapted to anchor one end of an engaged bowstring 34 or power cord 252, 262, 272.

With continuing reference to the non-limiting configurations of cams 38 shown in FIG. 3, a cam 38 may be a helical cam 38*b* comprising a first cam axis 456 about which a first helix curve 454 is defined. The first helix curve 454 may be a cylindrical helix curve or a spiral helix curve. The helix curve 456 may establish a path which a top channel 452 follows. The first helix curve may extend between two end planes 458, 459. In the non-limiting configuration shown in FIG. 3 end plane 458 coincides with first top surface 436. In some non-limiting embodiments, a cam 38 may optionally have an external securement feature 468 adapted to anchor one end of an engaged bowstring 34 or power cord 252, 262, 272.

In some non-limiting embodiments, a cam 38 may be arranged in a cam set 204 with one or more other cams 38 with the surface 436, 437 or end plane 458, 459 of a first cam 38 in contact with the surface 436, 437 or end plane 458, 459 of a second cam 38. In the non-limiting embodiment shown in FIG. 3 a first cam 38 is stacked with a second cam 38 so that the surface 436 is in contact with the end plane 458 of the second cam. While the embodiment shown in FIG. 3 is of one planar cam 38*a* and one helical cam 38*b*, other arrangements are acceptable. A cam set 204 can include multiple planar cams 38*a*, multiple helical cams 38*b*, or a plurality of both planar cams 38*a* and helical cams 38*b*. It is also contemplated that cams 38 may be arranged in a cam set where they are arranged coaxially, such that their axes 422, 456 coincide, but are offset by some margin such that they are not in contact with one another.

Figure 2A:
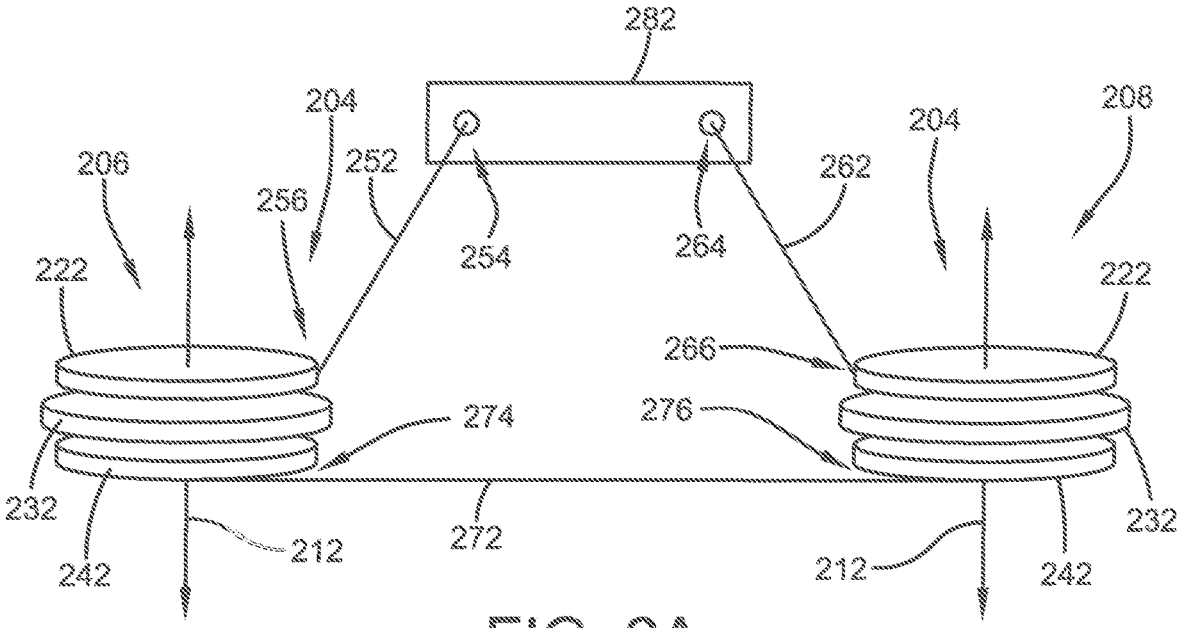
FIG. 2*a* is another view of a first non-limiting embodiment of a set of power cords and a set of cams.
Figure 2B:
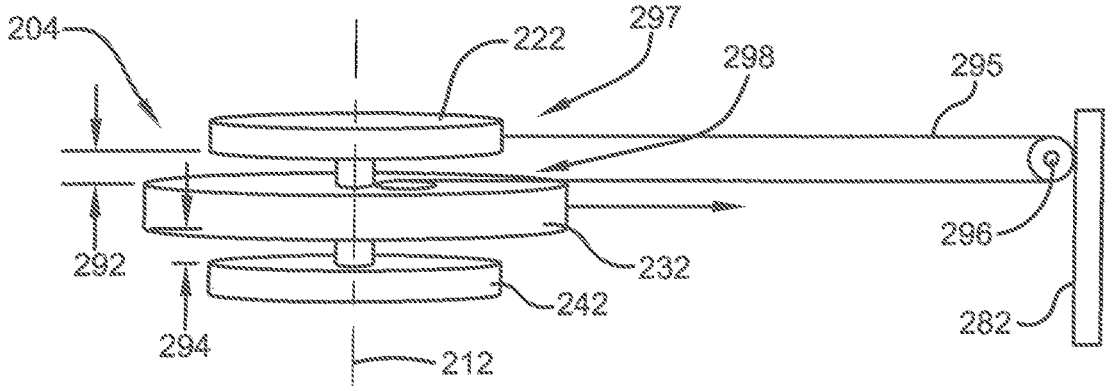
FIG. 2*b* is another view of a second non-limiting embodiment of a set of power cords and a set of cams.

As shown in FIG. 2A. In some non-limiting embodiments, a first cam may be engaged with one or more other cams 38 to form a cam set 204. In some non-limiting embodiments, all cams 38 in a cam set 204 are adapted to rotate synchronously about a common axis as shown in FIGS. 2A and 2B. In some embodiments in which all cams 38 in a cam set 204 are adapted to rotate synchronously about a common axis all of the cams are fixed with respect to a shaft 137 defining and rotatable about a first cam axis 212. It may be acceptable in some non-limiting embodiments for one or more cams in a cam set to rotate asynchronously with respect to one or more other cams in a cam set 204. The cams in a cam set 204 may be adapted to rotate asynchronously by operationally engaging the cams to one another through a shaft or other element that is adapted to twist sufficiently to be operatively important during operational loading. The cams 38 in a cam set 204 may be adapted to rotate asynchronously by operationally engaging the cams to one another through an epicyclic gearing.

Referring now to FIG. 2A, in a first non-limiting embodiment, a crossbow comprises two cam sets 204, a first cam set 206 and a second cam set 208, wherein each cam set 204 comprises a shaft 137, and three cams 38, including a first power cord cam 222, a bowstring cam 232, and a second power cord cam 242. The first power cord cam 222 in the first cam set 206 may be operationally engaged to a frame 282. The frame 282 may be riser 40, barrel 16, or other component chosen with good engineering judgment. The frame 282 is identical to, or is substantially fixed with respect to, the riser 40. As shown in first non-limiting embodiment depicted in FIG. 2A, power cord 252 is an elongated cord with a first end 254 operationally engaged with the frame 282 and a second end 256 opposite the first end 254 and operationally engaged with the first power cord cam 222 in the first cam set 206. The first power cord cam 222 in the second cam set 208 may be operationally engaged to the frame 282. As shown in first non-limiting embodiment depicted in FIG. 2A, power cord 262 is an elongated cord with a first end 264 operationally engaged with the frame 282 and a second end 266 opposite the first end 264 and operationally engaged with the first power cord cam 222 in the second cam set 208. The second power cord cam 242 in the first cam set 206 may be operationally engaged to the second power cord cam 242 in the second cam set 208 by a power cord 272. As shown in first non-limiting embodiment depicted in FIG. 2A, power cord 272 is an elongated cord with a first end 274 operationally engaged with the second power cord cam 242 in the first cam set 206 and a second end 276 opposite the first end 274 and operationally engaged with the second power cord cam 242 in the second cam set 208. A bowstring 34 is an elongated cord having a first end 34*a* operationally engaged with the bowstring cam 232 of the first cam set 206 and a second end 34*b* opposite the first end 34*a* and operationally engaged with the bowstring cam 232 of the second cam set 208.

In operation, each cam 204 is operationally engaged with a crossbow 10 such that when the bowstring 34 is being cocked, moved from the uncocked position shown in FIG. 1, by being pulled backwards along barrel 16, the applied cocking work causes the bowstring cam 232 at each end 34*a*, 34*b* of the bowstring 34 to rotate and for the cam sets 204 to move and flex each engaged limbs 36. All of the cams 38 in any given cam set 204 each rotate synchronously with each other cam 38 in the same given cam set 204. Accordingly, as the cocking operation causes the bowstring cam 232 in the first cam set 206 to rotate, the rotation is imparted synchronously to the first power cord cam 222 and the second power cord cam 242 of the first cam set 206. Similarly, as the cocking operation causes the bowstring cam 232 in the second cam set 208 to rotate, the rotation is imparted synchronously to the first power cord cam 222 and the second power cord cam 242 of the first cam set 208. As the second power cam 242 of the first cam set 206 rotates during cocking, it spools in power cord 272 from its first end 274; as the second power cam 242 of the second set 208 rotates during cocking, it spools in power cord 272 from its second end 276; because power cord 272 is being spooled in at each end 274, 276, the cams 242 pull each other along the power cord 272 and thereby each put a deflecting load on the engaged bow limb 36 in a direction along power cord 272 and toward the opposite cam 242. As the first power cord cam 222 of the first cam set 206 rotates during cocking, it spools in power cord 252 from its first end 256; because power cord 252 is being spooled in at end 256 and is fixed at end 254, the first power cord cam 222 of the first cam set 206 is pulled along the power cord 252 and thereby puts a deflecting load on the engaged bow limb 36 in a direction along power cord 252 and toward the frame 282. As the first power cord cam 222 of the second cam set 208 rotates during cocking, it spools in power cord 262 from its first end 266; because power cord 262 is being spooled in at end 266 and is fixed at end 264, the first power cord cam 222 of the first cam set 206 is pulled along the power cord 262 and thereby puts a deflecting load on the engaged bow limb 36 in a direction along power cord 262 and toward the frame 282.

In some non-limiting embodiments, in the cam set 206, the first power cord cam 222 is a planar cam 38*a*, the bowstring cam 232 is a planar cam 38*a*, and the second power cord is a helical cam 38*b*. In some non-limiting embodiments, in the cam set 208, the first power cord cam 222 is a planar cam 38*a*, the bowstring cam 232 is a planar cam 38*a*, and the second power cord is a helical cam 38*b*.

Figure 4:
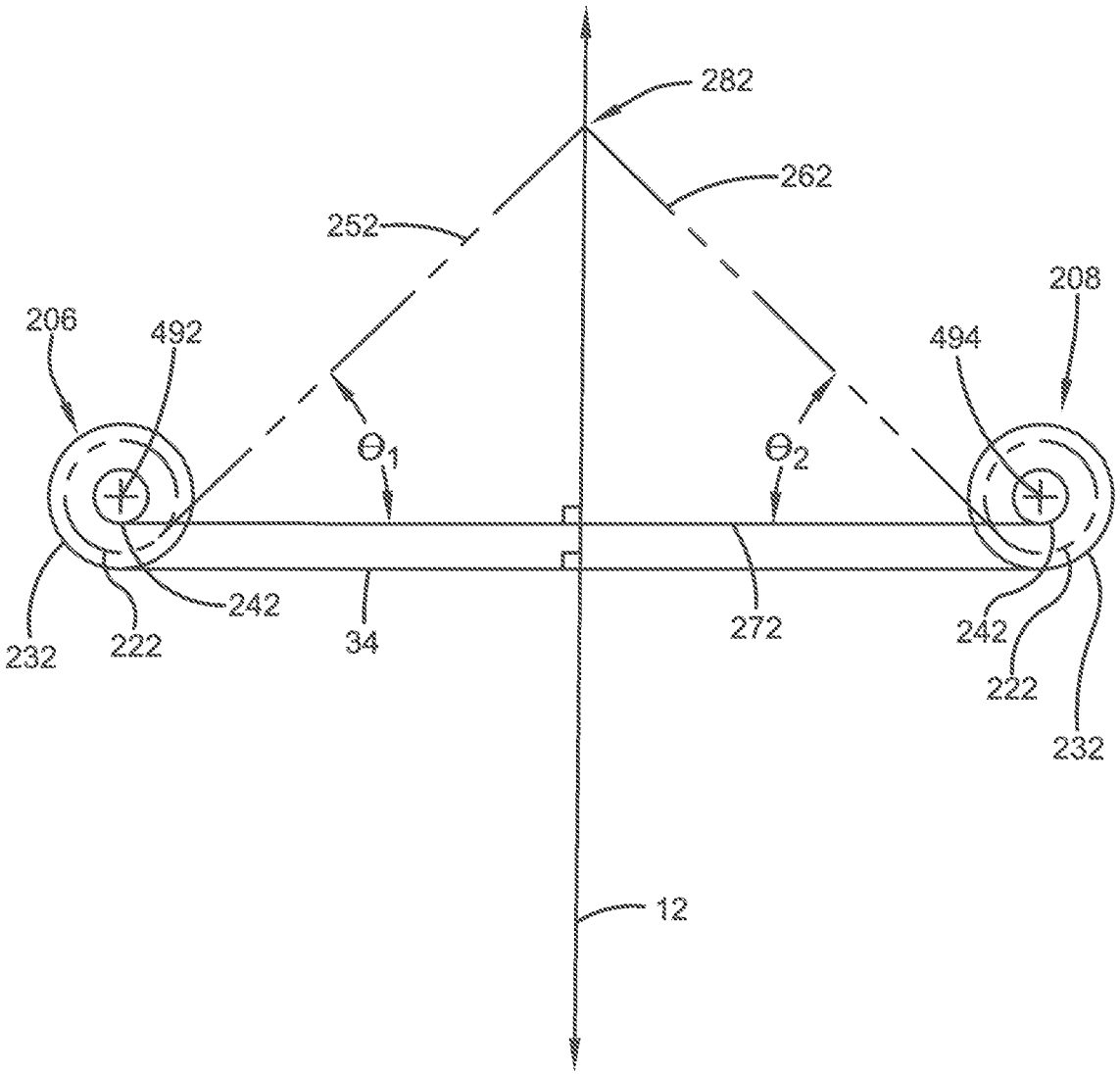
FIG. 4 is a schematic diagram showing one non-limiting embodiment of a crossbow.

With reference now to the non-limiting schematic diagram shown in FIG. 4, shown is a schematic of components of a crossbow 10 comprising main beam 12, cam set 206, cam set 208, cams 232, cam 222, cams 242, power cord 272, power cord 252, power cord 262, and bowstring 34. In the non-limiting embodiment shown power cords 252 is connected to frame 282 in such a manner that a plan view of the power cords shows power cord 252 at an angle .Theta 1. with respect to power cord 272. In the non-limiting embodiment shown power cords 262 is connected to frame 282 in such a manner that a plan view of the power cords shows power cord 262 at an angle .Theta 2. with respect to power cord 272. In the non-limiting embodiment shown .Theta 1. is equal to .Theta 2. In other acceptable non-limiting embodiments shown .Theta 1. is not equal to .Theta 2. In some non-limiting embodiments .Theta 1. is adjustable by adjusting the point at which power cord 252 connects to frame 282. In some non-limiting embodiments .Theta 2. is adjustable by adjusting the point at which power cord 262 connects to frame 282.

With reference now to FIG. 2B, in some embodiments, a cam set 204 may comprise a plurality of cams with one or more of the cams 38 offset from one another by one or more margins 292, 294. As shown in FIG. 2B, cam 222 is offset from cam 232 by margin 292, and cam 232 is offset from cam 242 by margin 294. In some non-limiting embodiments, as shown in FIG. 2B, a power cord 295 can be engaged with the cam set 204. In the embodiment shown, the power cord 295 has a first end 297 engaged with an internal securement feature 431 on cam 222, the power cord extends to and loops over a pully 296 engaged with a frame 282 and extends back the cam 223 where a second end 298 of the power cord 295 engages axis 212 or some other feature adapted to secure second end 298 within the margin 292.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

We claim:

1. A crossbow comprising
- a bow having
  - a riser having
    - a first riser side and
    - a second riser side opposite the first riser side,
  - a first limb set
    - engaged to the first riser side, and
    - defining a first limb axis;
  - a second limb set,
    - engaged to the second riser side, and
    - defining a second limb axis parallel to the first limb axis;
  - a first cam set having
    - a first shaft defining and rotatable about a first cam axis, the first shaft engaged with the first limb set such that the first cam axis coincides with the first limb axis,
    - a first power cord cam of the first cam set operationally engaged with the first shaft to be rotatable about the first cam axis,
    - a bowstring cam of the first cam set operationally engaged with the first shaft to be rotatable about the first cam axis,
    - a second power cord cam of the first cam set operationally engaged with the first shaft to be rotatable about the first cam axis;
  - a second cam set having
    - a second shaft defining and rotatable about a second cam axis, the second shaft engaged with the second limb set such that the second cam axis coincides with the second limb axis,
    - a first power cord cam of the second cam set operationally engaged with the second shaft to be rotatable about the second cam axis,
    - a bowstring cam of the second cam set operationally engaged with the second shaft to be rotatable about the second cam axis, a second power cord cam of the second cam set operationally engaged with the second shaft to be rotatable about the second cam axis;

an elongated first power cord having a first end of the elongated first power cord operationally engaged with the first power cord cam of the first cam set, and a second end of the elongated first power cord opposite the first end of the elongated first power cord operationally engaged with the first riser side;

an elongated second power cord having a first end of the elongated second power cord operationally engaged with the first power cord cam of the second cam set, and a second end of the elongated second power cord opposite the first end of the elongated second power cord operationally engaged with the second riser side;

an elongated third power cord having a first end of the elongated third power cord operationally engaged with the second power cord cam of the first cam set, and a second end of the elongated third power cord opposite the first end of the elongated third power cord operationally engaged with the second power cord cam of the second cam set; and an elongated bowstring having a first end of the elongated bowstring operationally engaged with the bowstring cam of the first cam set, and a second end of the elongated bowstring opposite the first end of the elongated bowstring operationally engaged with the bowstring cam of the second cam set; and wherein the bow has a top side facing in a top direction, the bowstring cam of the first cam set has a top side facing in a top direction that is the same as the top direction of the bow, and the bowstring cam of the second cam set has a top side facing in a top direction that is the same as the top direction of the bow and has a bottom side opposite the top side.

2. The crossbow of claim 1, wherein the first power cord cam of the first cam set, or the bowstring cam of the first cam set, or second power cord cam of the first cam set, or some combination thereof is movable in orientation, or position or both with respect to the first shaft.

3. The crossbow of claim 2, wherein the first power cord cam of the second cam set, or the bowstring cam of the second cam set, or second power cord cam of the second cam set, or some combination thereof is movable in orientation, or position or both with respect to the second shaft.

4. The crossbow of claim 1, wherein the first power cord cam of the first cam set, the bowstring cam of the first cam set, and second power cord cam of the first cam set are fixed in orientation and position with respect to the first shaft.

5. The crossbow of claim 4, wherein the first power cord cam of the second cam set, the bowstring cam of the second cam set, and second power cord cam of the second cam set are fixed in orientation and position with respect to the second shaft.

6. The crossbow of claim 5, wherein the first power cord cam of the first cam set is adjacent to the top side of the bowstring cam of the first cam set; and the first power cord cam of the second cam set is adjacent to the bottom side of the bowstring cam of the second cam set.

7. The crossbow of claim 5, wherein the first power cord cam of the first cam set is adjacent to the top side of the bowstring cam of the first cam set; and the first power cord cam of the second cam set is adjacent to the top side of the bowstring cam of the second cam set.

8. The crossbow of claim 7, wherein the second power cord cam of the first cam set is a helical cam.

9. The crossbow of claim 8, wherein the second power cord cam of the second cam set is a helical cam.

10. The crossbow of claim 9, wherein the first power cord cam of the first cam set is a planar cam.

11. The crossbow of claim 10, wherein the first power cord cam of the second cam set is a planar cam.

12. A method of using a crossbow comprising providing a crossbow having a bow having a riser having a first riser side and a second riser side opposite the first riser side, a first limb set engaged to the first riser side, and defining a first limb axis;

a second limb set, engaged to the second riser side, and defining a second limb axis parallel to the first limb axis;

a first cam set having a first shaft defining and rotatable about a first cam axis, the first shaft engaged with the first limb set such that the first cam axis coincides with the first limb axis, a first power cord cam of the first cam set operationally engaged with the first shaft to be rotatable about the first cam axis, a bowstring cam of the first cam set operationally engaged with the first shaft to be rotatable about the first cam axis, a second power cord cam of the first cam set operationally engaged with the first shaft to be rotatable about the first cam axis;

a second cam set having a second shaft defining and rotatable about a second cam axis, the second shaft engaged with the second limb set such that the second cam axis coincides with the second limb axis, a first power cord cam of the second cam set operationally engaged with the second shaft to be rotatable about the second cam axis, a bowstring cam of the second cam set operationally engaged with the second shaft to be rotatable about the second cam axis, a second power cord cam of the second cam set operationally engaged with the second shaft to be rotatable about the second cam axis;

an elongated first power cord having a first end of the elongated first power cord operationally engaged with the first power cord cam of the first cam set, and a second end of the elongated first power cord opposite the first end of the elongated first power cord operationally engaged with the first riser side;

an elongated second power cord having a first end of the elongated second power cord operationally engaged with the first power cord cam of the second cam set, and a second end of the elongated second power cord opposite the first end of the elongated second power cord operationally engaged with the second riser side;

an elongated third power cord having a first end of the elongated third power cord operationally engaged with the second power cord cam of the first cam set, and a second end of the elongated third power cord opposite the first end of the elongated third power cord operationally engaged with the second power cord cam of the second cam set; and an elongated bowstring having a first end of the elongated bowstring operationally engaged with the bowstring cam of the first cam set, and a second end of the elongated bowstring opposite the first end of the elongated bowstring operationally engaged with the bowstring cam of the second cam set; and wherein the bow has a top side facing in a top direction, the bowstring cam of the first cam set has a top side facing in a top direction that is the same as the top direction of the bow, and the bowstring cam of the second cam set has a top side facing in a top direction that is the same as the top direction of the bow and has a bottom side opposite the top side; and moving the bowstring between a cocked position and an uncocked position.

13. The method of claim 12, wherein the first power cord cam of the first cam set, or the bowstring cam of the first cam set, or second power cord cam of the first cam set, or some combination thereof is movable in orientation, or position or both with respect to the first shaft.

14. The method of claim 13, wherein the first power cord cam of the second cam set, or the bowstring cam of the second cam set, or second power cord cam of the second cam set, or some combination thereof is movable in orientation, or position or both with respect to the second shaft.

15. The method of claim 12, wherein the first power cord cam of the first cam set, the bowstring cam of the first cam set, and second power cord cam of the first cam set are fixed in orientation and position with respect to the first shaft.

16. The method of claim 15, wherein the first power cord cam of the second cam set, the bowstring cam of the second cam set, and second power cord cam of the second cam set are fixed in orientation and position with respect to the second shaft.

17. The method of claim 16, wherein the first power cord cam of the first cam set is adjacent to the top side of the bowstring cam of the first cam set; and the first power cord cam of the second cam set is adjacent to the bottom side of the bowstring cam of the second cam set.

18. The method of claim 16, wherein the first power cord cam of the first cam set is adjacent to the top side of the bowstring cam of the first cam set; and the first power cord cam of the second cam set is adjacent to the top side of the bowstring cam of the second cam set.

19. The method of claim 18, wherein the second power cord cam of the first cam set is a helical cam;

the second power cord cam of the second cam set is a helical cam;

the first power cord cam of the first cam set is a planar cam; and the first power cord cam of the second cam set is a planar cam.

* * * * *